US012729514B2

(12) United States Patent
Shen et al.

(10) Patent No.: US 12,729,514 B2
(45) Date of Patent: Sep. 8, 2026

(54) SYSTEM AND METHOD OF BULLDOZER SIX-WAY BLADE SWING ANGLE ESTIMATION

(71) Applicant: Honeywell International Inc., Charlotte, NC (US)

(72) Inventors: Zhizhen Shen, Shanghai (CN); Xiao Cao, Shanghai (CN); Yanling Min, Shanghai (CN)

(73) Assignee: Honeywell Aerospace US LLC, Phoenix, AZ (US)

( * ) Notice: Subject to any disclaimer, the term of this patent is extended or adjusted under 35 U.S.C. 154(b) by 344 days.

(21) Appl. No.: 18/508,096

(22) Filed: Nov. 13, 2023

(65) Prior Publication Data

US 2025/0154746 A1 May 15, 2025

(51) Int. Cl.
*E02F 9/26* (2006.01)
*E02F 3/76* (2006.01)

(52) U.S. Cl.
CPC ..... *E02F 9/264* (2013.01); *E02F 3/7609* (2013.01)

(58) Field of Classification Search
CPC ..... E02F 3/7609; E02F 3/7613; E02F 3/7618; E02F 9/264
See application file for complete search history.

(56) References Cited

U.S. PATENT DOCUMENTS

| | | | | |
|---|---|---|---|---|
| 9,988,787 | B1 * | 6/2018 | Wang | G01S 19/53 |
| 10,316,491 | B2 | 6/2019 | Gentle et al. | |
| 10,962,360 | B2 | 3/2021 | Olgesby et al. | |
| 10,968,606 | B2 * | 4/2021 | Green | G01C 19/00 |
| 11,629,476 | B2 | 4/2023 | Zhao et al. | |
| 2004/0221490 | A1 | 11/2004 | Cooper et al. | |
| 2009/0223091 | A1 | 9/2009 | Livingston et al. | |
| 2016/0028460 | A1 | 1/2016 | Chen et al. | |
| 2016/0109270 | A1 * | 4/2016 | Zabegaev | G01P 21/00 702/141 |
| 2016/0252909 | A1 | 9/2016 | Webber et al. | |
| 2016/0319511 | A1 | 11/2016 | Chang et al. | |
| 2017/0114528 | A1 * | 4/2017 | Kosarev | E02F 9/265 |
| 2021/0293972 | A1 | 9/2021 | Tamazato | |

(Continued)

FOREIGN PATENT DOCUMENTS

| | | | |
|---|---|---|---|
| CN | 113107043 | A | 7/2021 |
| CN | 111511993 | B | 6/2022 |
| CN | 113047353 | B | 9/2022 |
| CN | 217741776 | U | 11/2022 |
| CN | 114396091 | B | 12/2022 |
| EP | 2191291 | B1 | 7/2014 |
| KR | 102479701 | B1 | 12/2022 |

OTHER PUBLICATIONS

U.S. Patent and Trademark Office, "Office Action", U.S. Appl. No. 18/517,954, dated Aug. 11, 2025, pp. 1 through 85, Published: US.

(Continued)

*Primary Examiner* — Matthew R Buck
(74) *Attorney, Agent, or Firm* — Fogg & Powers LLC

(57) ABSTRACT

Parameters of a six-way blade coupled to a vehicle are determined based on attitude measurements determined from a plurality of inertial sensors coupled to the vehicle. The vehicle can be a bulldozer. The parameters of the six-way blade can include the swing angle of the blade with respect to an attachment member that couples the blade to the vehicle body, as well as the relative heading of the blade with respect to the heading of the vehicle body.

19 Claims, 10 Drawing Sheets

(56) References Cited

U.S. PATENT DOCUMENTS

| | | | | |
|---|---|---|---|---|
| 2023/0129397 | A1* | 4/2023 | Velde | E02F 3/3677 701/50 |
| 2023/0203779 | A1 | 6/2023 | Kamimae | |
| 2025/0163682 | A1 | 5/2025 | Cao et al. | |

OTHER PUBLICATIONS

Great Britain Intellectual Property Office, "Patents Act 1977: Search Report under Section 17(5)", dated Mar. 4, 2025, from GB Application No. GB2415969.1, from Foreign Counterpart to U.S. Appl. No. 18/508,096, pp. 1 through 4, Published: GB.

Great Britain Intellectual Property Office, "Patents Act 1977: Search Report under Section 17(5)", dated Mar. 24, 2025, from GB Application No. GB2416112.7, from Foreign Counterpart to U.S. Appl. No. 18/517,954, pp. 1 through 3, Published: GB.

Great Britain Intellectual Property Office, "Patents Act 1977: Search Report under Section 17(5)", dated May 7, 2025, from GB Application No. GB2415969.1, from Foreign Counterpart to U.S. Appl. No. 18/508,096, pp. 1 through 4, Published: GB.

U.S. Patent and Trademark Office, "Corrected Notice of Allowability", U.S. Appl. No. 18/517,954, dated Feb. 23, 2026, pp. 1 through 4, Published: US.

U.S. Patent and Trademark Office, "Notice of Allowance", U.S. Appl. No. 18/517,954, dated Feb. 13, 2026, pp. 1 through 13, Published: US.

* cited by examiner

600

| | Body 102 | | Attachment Member 104 | | Intermediate Blade Frame | | Blade 106 |
|---|---|---|---|---|---|---|---|
| Quaternion | $q_1$ | | $q_2$ | | $q_4$ | | $q_3$ |
| Yaw | $\psi_1$ | $q_{lift}$ | $\psi_2$ | $q_{swing}$ | $\psi_4$ | $q_{tilt}$ | $\psi_3$ |
| Pitch | $\theta_1$ | | $\theta_2$ | | $\theta_4$ | | $\theta_3$ |
| Roll | $\phi_1$ | | $\phi_2$ | | $\phi_4$ | | $\phi_3$ |

FIG. 6

700

| 702 Variable | 704 Description | 706 Source |
|---|---|---|
| $\theta_2$ | Pitch of lift arm 104 | Lift sensor 206 |
| $\phi_2$ | Roll of lift arm 104 | Lift sensor 206 |
| $\theta_3$ | Pitch of blade 106 | Blade sensor 206 |
| swing | Swing of blade 106 | Processor 210 |

FIG. 7

800

802 804 806

| Variable | Description | Source |
|---|---|---|
| $\psi_1$ | Yaw of body 102 | Body sensor 208 |
| $\theta_1$ | Pitch of body 102 | Body sensor 208 |
| $\phi_1$ | Roll of body 102 | Body sensor 208 |
| $q_1$ | Rotation from reference frame to body frame | Processor 210 |
| $\psi_2$ | Yaw of lift arm 104 | Lift arm sensor 206 |
| $\theta_2$ | Pitch of lift arm 104 | Lift arm sensor 206 |
| $\phi_2$ | Roll of lift arm 104 | Lift arm sensor 206 |
| $q_2$ | Rotation from reference frame to lift arm frame | Processor 210 |
| $\psi_3$ | Yaw of blade 106 | Processor 210 |
| $\theta_3$ | Pitch of blade 106 | Blade sensor 204 |
| $\phi_3$ | Roll of blade 106 | Blade sensor 204 |
| $\psi_4$ | Yaw of intermediate blade frame | Processor 210 |
| $\theta_4$ | Pitch of intermediate blade frame | Processor 210 |
| $\phi_4$ | Roll of intermediate blade frame | Processor 210 |
| $q_4$ | Rotation from reference frame to intermediate blade frame | Processor 210 |
| $\Delta\psi$ | Blade relative heading | Processor 210 |
| lift | Lift angle of lift arm 104 | Processor 210 |
| swing | Swing angle of blade 106 | Processor 210 |
| tilt | Tilt angle of blade 106 | Processor 210 |

FIG. 8

SYSTEM AND METHOD OF BULLDOZER SIX-WAY BLADE SWING ANGLE ESTIMATION

BACKGROUND

Bulldozers are widely used in industrial applications such as in mining and construction. A bulldozer is typically constructed with three main components: a body, which serves as the main structure of the vehicle and which enables the operator to control the vehicle; a blade, which is configured for movement to gather and/or transport materials; and an attachment member (alternatively referred to as a "C-frame" or "lift arm") that controls the lifting position of the blade. The dozer blade is coupled to the C-frame by semi-rigid coupling. The vehicle body generally moves laterally against a surface in three-dimensions, the attachment member moves vertically with respect to the vehicle body, and the blade moves horizontally. The blade is configured to tilt left and right with respect to the attachment member. Accordingly, the blade is configured for six-way movement with respect to the attachment member. Movement of the bulldozer, and each component, can be characterized using rigid body kinematics and dynamics.

Although some motion parameters can be determined to high accuracy, blade heading related parameters are much more difficult to determine. Two particular examples are the reference swing angle of the blade with respect to the attachment member, and the relative heading of the blade with respect to the vehicle body. However, knowing the motion and orientation of the blade is important for many applications, for example, in automated driving or driving assistance.

SUMMARY

The details of one or more embodiments are set forth in the description below. The features illustrated or described in connection with one exemplary embodiment may be combined with the features of other embodiments. Thus, any of the various embodiments described herein can be combined to provide further embodiments. Aspects of the embodiments can be modified, if necessary to employ concepts of the various patents, applications and publications as identified herein to provide yet further embodiments.

In one embodiment, a system is disclosed. The system comprises a vehicle comprising a body, a blade, and an attachment member that couples the blade to the body. The attachment member is configured for lift movement, wherein the lift movement is defined as a rotation along a horizontal axis with respect to the body. The blade is configured for swing movement, wherein the swing movement is defined as a rotation along an axis orthogonal to an axis of the lift movement with respect to the attachment member. The system comprises a plurality of sensors mounted on the vehicle. At least one first sensor of the plurality of sensors is configured to determine attitude measurements of the blade with respect to an inertial reference frame. At least one second sensor of the plurality of sensors is configured to determine attitude measurements of the attachment member with respect to the inertial reference frame. The system comprises at least one processor coupled to or integrated in the at least one first sensor. The at least one processor is configured to determine at least one parameter of the blade based on the attitude measurements of the blade and the attitude measurements of the attachment member. The at least one parameter includes a swing angle of the blade relative to the attachment member.

In another embodiment, a method for determining parameters of a blade attached to a vehicle is disclosed. The vehicle includes a body and an attachment member that couples the blade to the body. Movement of the blade is defined orthogonal to an axis of motion with respect to the attachment member. The attachment member is configured for lift movement, wherein the lift movement is defined as a rotation along a horizontal axis with respect to the body. The blade is configured for swing movement, wherein the swing movement is defined as a rotation along an axis orthogonal to an axis of the lift movement with respect to the attachment member. The method comprises determining attitude measurements of the blade with respect to an inertial reference frame. The method comprises determining attitude measurements of the attachment member with respect to the inertial reference frame. The method comprises determining a swing angle of the blade with respect to the attachment member based on the attitude measurements of the blade and the attitude measurements of the attachment member.

In yet another embodiment, a sensor system is disclosed. The sensor system is configured to be coupled to a vehicle. The vehicle comprises a body, a blade, and an attachment member that couples the blade to the body. The sensor system comprises at least one first sensor. The at least one first sensor is configured to determine first attitude measurements of the blade. The first attitude measurements are determined with respect to an inertial reference frame. The first attitude measurements include an attitude of the blade corresponding to horizontal rotation of the blade defined orthogonal to an axis of the attachment member. The sensor system comprises at least one second sensor. The at least one second sensor is configured to determine second attitude measurements of the attachment member. The second attitude measurements are determined with respect to the inertial reference frame. The second attitude measurements include an attitude of the attachment member corresponding to vertical rotation of the attachment member defined orthogonal to an axis of the body. The sensor system comprises at least one processor coupled to, or integrated in, the at least one first sensor and the at least one second sensor. The at least one processor is configured to determine a swing angle of the blade relative to the attachment member based on the first attitude measurements and the second attitude measurements.

Additional embodiments are also disclosed, as subsequently described.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, as immediately follows and as subsequently described in the detailed description.

FIG. 6 depicts a table of attitude measurements between different components of a vehicle, as described in one or more embodiments.

FIG. 7 depicts a table of attitude measurements used to determine the swing angle of a blade, as described in one or more embodiments.

FIG. 8 depicts a table of attitude measurements used to determine the relative heading of the blade with respect to the vehicle body, as described in one or more embodiments.

Figure 1:
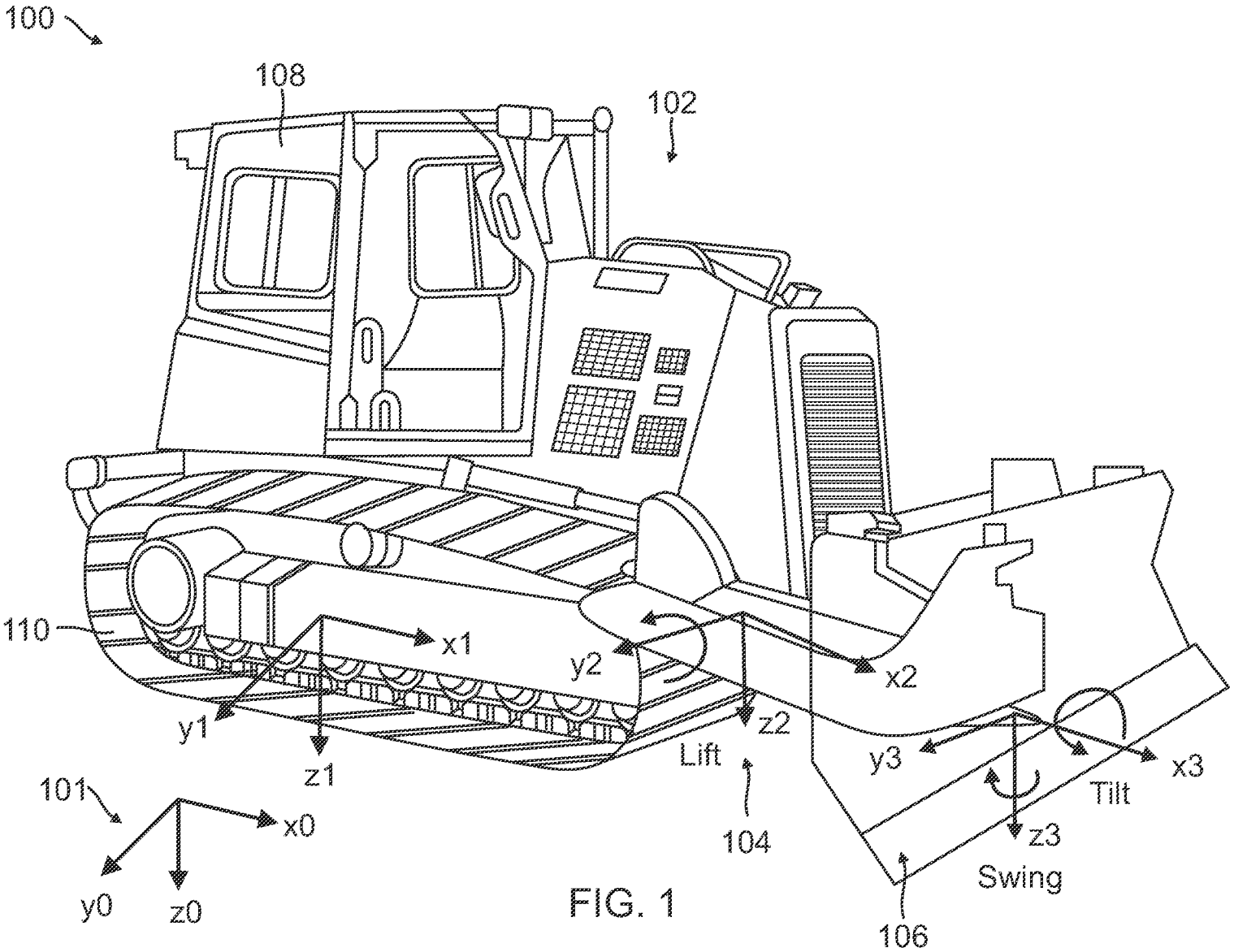
FIG. 1 depicts a block diagram of a vehicle in which the techniques described herein can be implemented, as described in one or more embodiments.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

FIG. 1 depicts a vehicle 100 in which the techniques described herein can be implemented. Vehicle 100 is represented as a bulldozer for pedagogical explanation, understanding that the other vehicles may be used with similar configurations as described in FIG. 1. Vehicle 100 includes a body 102, a blade 106, and an attachment member 104. The vehicle body 102 is configured for three-dimensional movement with respect to a surface. For example, body 102 includes a rotor assembly 110 which enables vehicle 100 to move. Additionally, body 102 includes a chassis 108 that houses a control interface in which an operator can operate and control vehicle 100. In some embodiments, the operator can utilize a workstation device (see FIG. 3) that receives information from the sensors disposed on vehicle 100.

Figure 5:
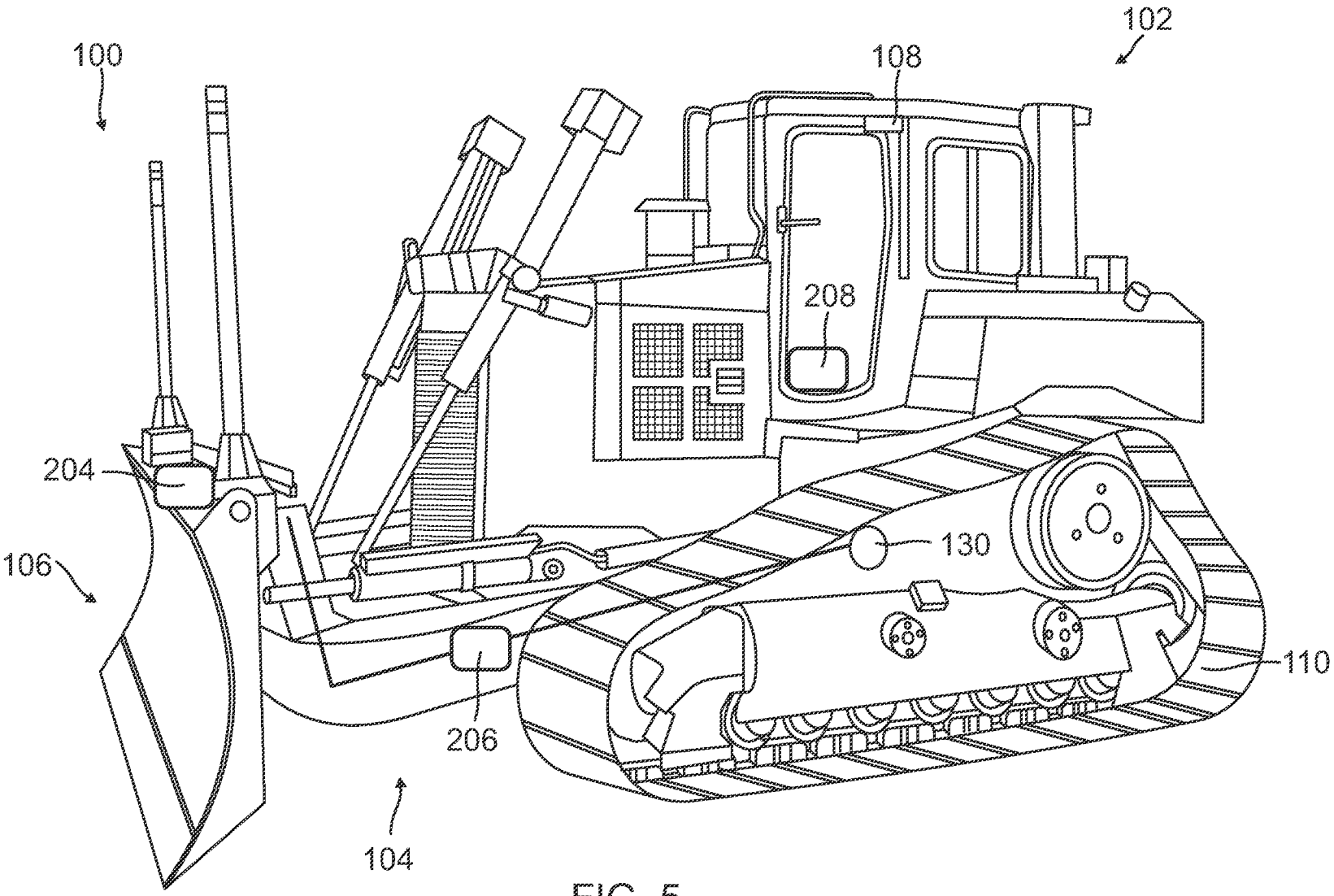
FIG. 5 depicts a block diagram of a vehicle with a plurality of sensors mounted on different portions of the vehicle, as described in one or more embodiments.

The attachment member 104 is suitably coupled to an end of vehicle body 102, for example, by mounting ankles 130 (see FIG. 5). Attachment member 104 can be referred to as a "C-frame" or "lift arm". Its movement is defined by one degree of freedom with respect to vehicle body 102. For example, referring to the three-dimensional Cartesian coordinate system in FIG. 1, attachment member 104 is configured for lift movement with respect to a rotation about the y2 axis. This enables attachment member 104 to move vertically up and down relative to body 102. The movement is facilitated by mounting ankles 130 and driven by a power source such as hydraulic pushrods. Because attachment member 104 only has one degree of freedom, attachment member 104 has no relative rotation about the x2 and z2 axes and only moves according to the lift movement about the y2 axis. The motion of attachment member 104 (and of the other components of vehicle 100 described herein) can be defined by other types of coordinate systems.

Movement of blade 106 is described with respect to its own coordinate system defined by the axes z3, x3, and y3 as shown in FIG. 1. In contrast with the attachment member 104, blade 106 is allowed two degrees of movement for a total movement in six-directions, including the lift movement with attachment member 104. In this respect, blade 106 is sometimes referred to as a "six-way blade" 106. In FIG. 1, blade 106 is configured to rotate about the x3 axis. Such movement is referred to as "tilt movement" in which one side (left side, for example) of the blade 106 rotates up or down, with the opposite side (e.g., right side) tilting in the opposite direction in order control the bottom edge of the blade to an appropriate position Additionally, blade 106 is configured to rotate about the z3 axis. This movement is referred to as "angle movement" or alternatively as "swing movement". When undergoing swing movement, blade 106 "swings" left or right relative to the attachment member 104, visualized by one side (e.g., left side) of the blade 106 rotating forward or backward direction and the opposite side (e.g., right side) rotating in the opposite of the forward or backward direction. The lift movement of blade 106 is synchronized with the lift movement of attachment member 104, so that both the attachment member 104 and the blade 106 lift simultaneously in parallel.

A reference coordinate system 101 can be used to determine the orientation of the various components of vehicle 100. For example, the reference coordinate system 101 can be defined in a frame relative to a surface or other external reference point relative to vehicle 100. As shown in FIG. 1, the reference coordinate system 101 is defined in three-dimensional Cartesian space to have axes x0, y0, z0.

Each of the rotations associated with attachment member 104 and blade 106 can be described in terms of rotation angles about the appropriate axis. For example, the orientation of attachment member 104 with respect to the y2 axis can be expressed as the lift angle, which changes as attachment member 104 moves about the y2 axis. The orientation of blade 106 with respect to the z3 axis can be expressed as the swing angle, which changes as blade 106 moves about the z3 axis. Additionally, the orientation of blade 106 with respect to the x3 axis can be expressed as the tilt angle, and likewise changes when the blade 106 tilts clockwise or counterclockwise. Each of these angles can be represented by a set of Euler angles with each Euler angle defined for a respective axis. The Euler angle characterizing the orientation with respect to the x axis (e.g., the x2, x3 axes) is the roll angle, the Euler angle characterizing the orientation with respect to the z axis (e.g., the z2, z3 axes) is the yaw angle, and the Euler angle characterizing the orientation with respect to the y axis (e.g., the y2, y3) axes is the pitch angle. Accordingly, the complete orientation of attachment member 104 and blade 106 in three-dimensional space can be captured by their respective configuration of yaw and roll angles. In some embodiments, the orientation and movement of blade 106 is defined first by the lift angle, followed by the swing angle, and followed by the tilt angle. Some of these angles are difficult to capture during operation of vehicle 100. In particular, the swing angle of blade 106 is difficult to determine because it is a yaw movement and cannot be inferred via traditional methods from effects of gravity acting on the blade 106.

Figure 2:
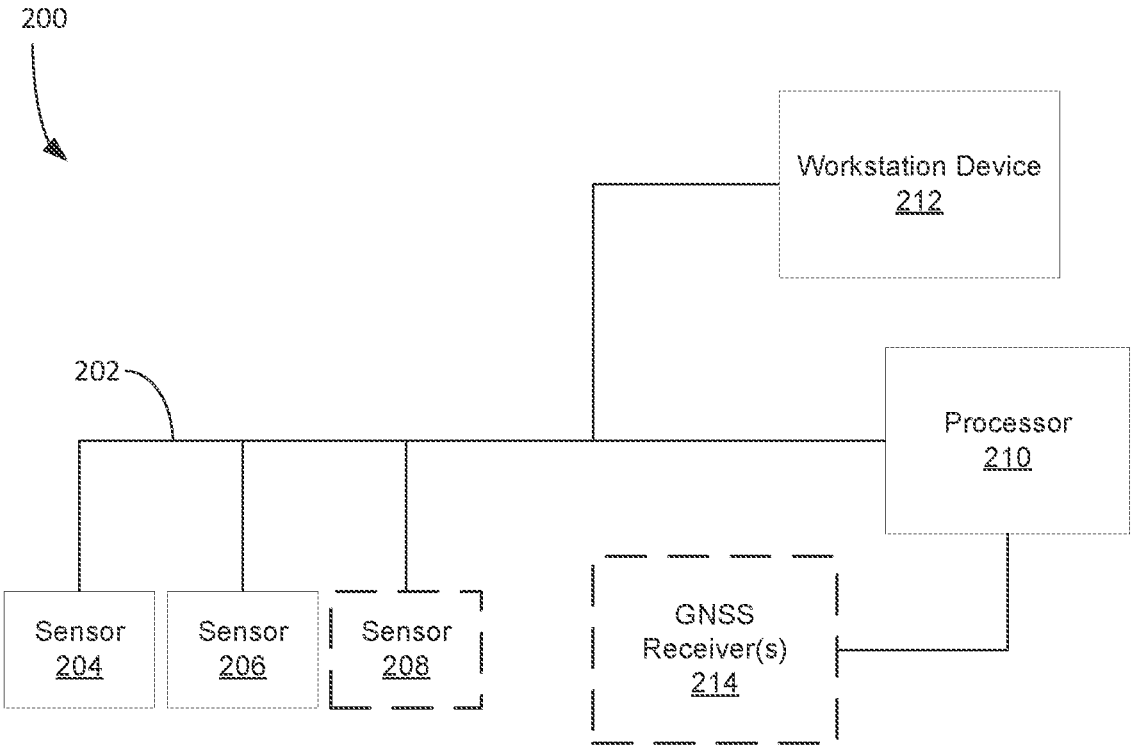
FIG. 2 depicts a block diagram of a motion sensing circuit mounted on a vehicle, as described in one or more embodiments.

FIG. 2 depicts a block diagram of a motion sensing circuit 200 mounted on a vehicle, such as vehicle 100 of FIG. 1. Motion sensing circuit 200 includes a communication bus 202 that connects multiple devices together on vehicle 100. For example, communication bus 202 can be a controller area network (CAN) bus, which can be implemented via electrical wiring or other communication media that connects devices mounted between different parts of vehicle 100.

Motion sensing circuit 200 further includes a plurality of sensors mounted on vehicle 100. A first sensor 204 is coupled to blade 106, for example, on the top of the blade, and may be referred to as "blade sensor 204". A second sensor 206 is coupled to attachment member 104 and configured to monitor movement with respect to the attachment member, and may be referred to as "attachment member sensor 206". And optionally, a third sensor 208 is coupled to a portion of vehicle body 102, such as inside the chassis 108, and may be referred to as a "body sensor 208". Each of these sensors are coupled to a workstation device 212. Workstation device 212 is an electronic device such as a laptop, smartphone, tablet, or other portable or onboard electronic device. In the case of a portable electronic device, workstation device 212 can be coupled to communication bus 202 via a wireless communication link. In the case of an electronic device mounted in the chassis, workstation device 212 can be coupled to communication bus 202 via one or more connecting ports.

Although FIG. 2 depicts a single sensor 204, sensor 206, and sensor 208, multiple sensors of each can be used. For example, multiple sensors 204 can be mounted on different parts of the blade 106, multiple sensors 206 can be mounted on different parts of the attachment member 104, and multiple sensors 208 can be mounted on different parts of the body 102. In some embodiments, the sensors 204, 206, 208 include an inertial measurement unit (IMU). Additionally, or alternatively, some of these sensors include at least one tri-axis accelerometer, and/or at least one tilt sensor.

Additionally, motion sensing circuit 200 includes at least one processor 210. Processor 210 can be integrated in at least one of the sensors 204, 206, 208, but can be implemented as a separate processing circuit as shown in FIG. 2. Processor 210 may include any one or combination of processors, microprocessors, digital signal processors, application specific integrated circuits, field programmable gate arrays, and/or other similar variants thereof. Processor 210 may also include, or function with, software programs, firmware, or other computer readable instructions for carrying out various process tasks, calculations, and control functions, used in the methods described below. These instructions are typically tangibly embodied on any storage media (or computer readable media) used for storage of computer readable instructions or data structures. Optionally, one or more Global Navigation Satellite Systems (GNSS) receivers 214 are coupled to various portions of vehicle 100. GNSS receiver 214 can determine three-dimensional position or heading information that can be used by processor 210 to supplement the motion and orientation of the vehicle body 102 (as measured by optional third sensor 208).

Figure 3:
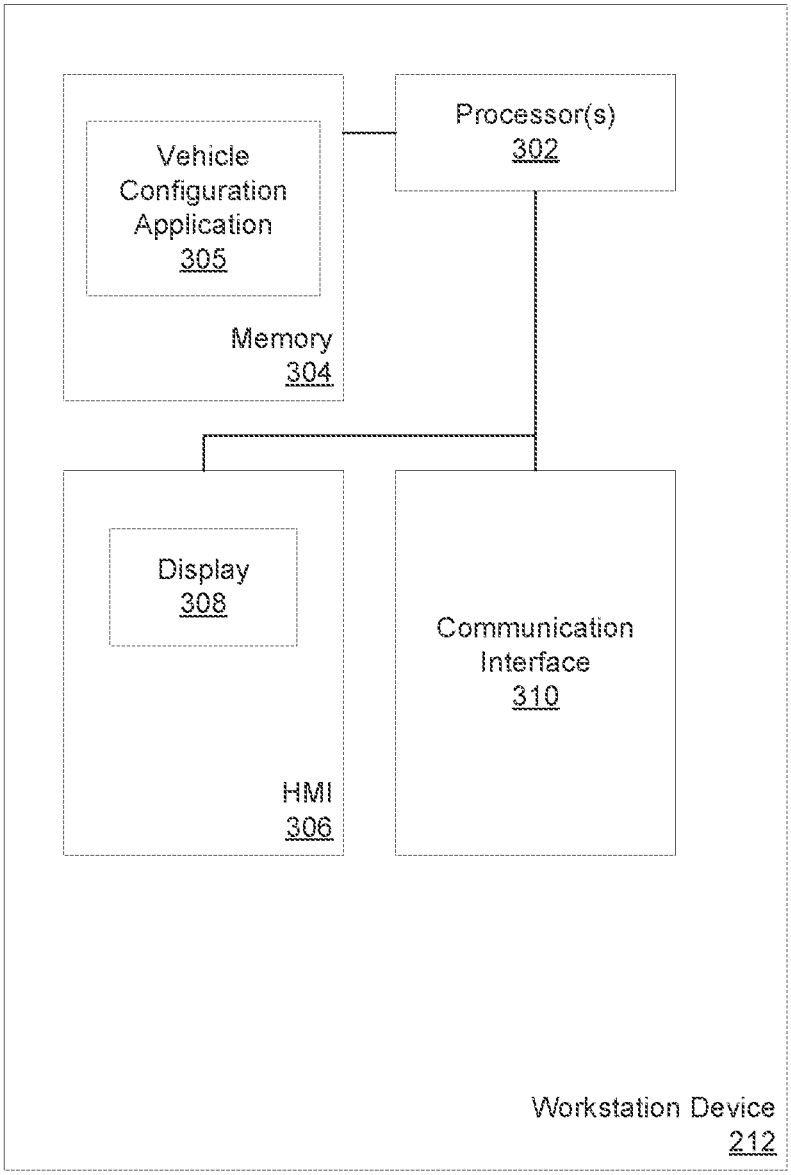
FIG. 3 depicts a block diagram of a workstation device, as described in one or more embodiments.

FIG. 3 depicts a block diagram of an exemplary workstation device 212 that can be used to interface with the sensors on vehicle 100. Workstation device 212 can be mounted on vehicle 100, for example, on the control panel in chassis 108, or can be a portable electronic device that can be taken off vehicle 100. Workstation device 212 includes one or more processors 302 coupled to a human-machine interface (HMI) 306, a communication interface 310, and a memory 304. HMI 306 is configured to receive user input and to display information received or generated by workstation device 212 on one or more display screens 308. For example, display screen 308 can be a touchscreen that enables the vehicle operator to input data to workstation device 212 directly on the touchscreen. In some embodiments, HMI 306 includes button(s), keyboard(s), knob(s), switch(es), or other input devices that the vehicle operator may use in inputting data.

Memory 304 is configured to store a vehicle configuration application 305 that enables processor 302 to receive and optionally process data from sensors 204, 206, 208, and processor 210. For example, in executing the instructions of vehicle configuration application 305, processor 302 receives attitude measurements of each of the sensors and the parameters of the blade 106, such as the swing angle and the relative heading, and causes the parameters to be displayed on display 308 to the vehicle operator. As blade 106, attachment member 104, or body 102 undergoes movement, the data displayed on 308 changes in response to receiving updated parameters by motion sensing circuit 200.

Data is received from motion sensing circuit 200 through communication interface 310. In the case of a portable workstation device 212, communication interface 310 includes a wireless interface such as a USB port that connects to a receiving port on communication bus 202. In other embodiments, communication interface 310 includes a wired interface such as electrical wiring that physically couples workstation device 212 to communication bus 202.

Figure 4:
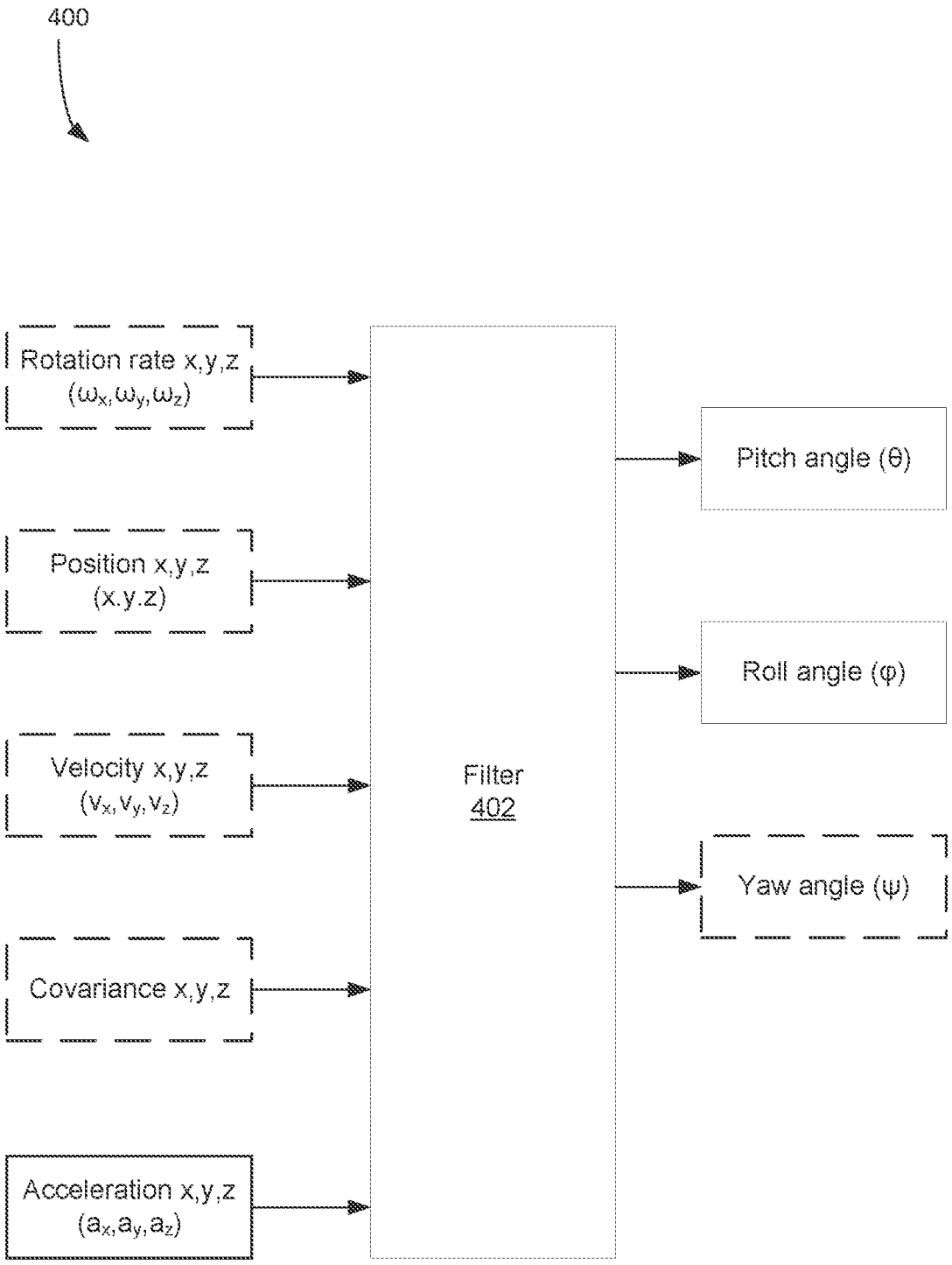
FIG. 4 depicts a block diagram of processing logic configured to determine attitude measurements, as described in one or more embodiments.

FIG. 4 depicts a block diagram of processing logic 400 configured to determine attitude measurements. Processing logic 400 can be implemented, for example, in any one or more of sensors 204, 206, 208. In some embodiments, processing logic 400 is implemented in processor 210 or processor 302 of workstation device 212. Each sensor 204, 206, 208 is configured to determine three-dimensional axis linear acceleration from e.g., an accelerometer integrated in each of the respective sensors. In some embodiments, the rotation rate is also measured with respect to a three-dimensional axis, in the case of an accelerometer, gyroscope, or combination thereof, disposed in at least one of sensors 204, 206, 208. Raw rotation rate measurements $\omega_x$, $\omega_y$, $\omega_z$ are optionally input and determined with respect to the frame of the component of vehicle 100 that the sensor is coupled to (e.g., a blade sensor 204 measures rotation rate with respect to blade 106).

Optionally, other inertial data is used to calculate the attitude measurements with respect to a component of vehicle 100. For example, processing logic 400 optionally uses position information in the x, y, and z coordinates. Such information can be acquired by the respective sensor 204, 206, 208, or can optionally be provided by GNSS receiver 214. Additionally, processing logic 400 optionally receives velocity measurements in the x, y, and z coordinates, along with the covariance information in the x, y, and z dimensions. Other inertial data can also be measured, depending on the sensor that is used.

Processing logic 400 combines each of the raw inertial measurements, including the acceleration and optional rotation rate, position, velocity, and covariance, into a filter 402. In some embodiments, filter 402 is a Kalman filter, complimentary filter, or other kind of processing filter that uses sensor fusion techniques to combine the raw inertial measurements. In some embodiments, data from other sensors can be combined by filter 402.

Filter 402 then outputs one or more attitude measurements of a component of vehicle 100 based on the raw inertial measurements. The attitude measurements are determined with respect to at least one Euler angle characterizing the orientation of the component being monitored. As shown in FIG. 4, processing logic 400 computes the pitch angle ($\theta$) and roll angle ($\varphi$) with respect to a reference frame of the component. In the case of coupling sensor 204 on blade 106, for example, processing logic 400 implemented in sensor 204 is configured to determine the pitch angle and roll angle of blade 106 in the reference frame of blade 106. Alternatively, if sensor 206 is coupled to attachment member 104, processing logic 400 implemented in sensor 206 is configured to output the pitch angle and roll angle of attachment member 104 in the reference frame of attachment member 104. Optionally, processing logic is configured to determine the yaw angle ($\psi$) of a component of vehicle 100. For example, if sensor 206 is coupled to vehicle body 102, then processing logic 400 implemented in sensor 206 is configured to determine the yaw angle (i.e. heading) of vehicle body 102 in the reference frame of the vehicle body 102.

FIG. 5 depicts a block diagram of a vehicle 100 with a plurality of sensors mounted on different portions of the vehicle. Referring to FIGS. 2-3, the first sensor 204 is mounted on top of the blade 106, while a second sensor 206 is mounted on a portion of the attachment member 104. Optionally, a third sensor 208 is mounted in chassis 108 of the vehicle body 102.

Since first sensor 204 is mounted on blade 106, the first sensor 204 is configured to measure the attitude of the blade 106 with respect to at least one of the Euler angles in the reference frame of the blade 106. In some embodiments, first sensor 204 measures the pitch angle $\theta_3$ of blade 106 (the angle defined by the orientation of the blade 106 with respect to the y3 axis) and the roll angle $\varphi_3$ of blade 106 (defined by the orientation of the blade 106 with respect to the x3 axis). Meanwhile, second sensor 206 is mounted on the attachment member 104 and is configured to measure the attitude of the attachment member 104 with respect to at least one of the Euler angles in the reference frame of the attachment member 104. For example, second sensor 206 measures the pitch angle $\theta_2$ of attachment member 104 (defined by the orientation of the attachment member 104 with respect to the y2 axis) and the roll angle $\varphi_2$ of attachment member 104 (defined by the orientation of the attachment member 104 with respect to the x2 axis). These attitude measurements are then provided to processor 210 for determination of the swing angle of blade 106 with respect to the frame of attachment member 104.

FIG. 6 depicts a table 600 of attitude measurements between different components of a vehicle. The attitude of vehicle body 102 is characterized by its pitch angle $\theta_1$, roll angle $\varphi_1$, and yaw angle ("heading") $\psi_1$. Additionally, the orientation of body 102 is characterized by the quaternion $q_1$ describing the rotation of body 102 relative to a reference frame 101. The orientation of attachment member 104 is characterized by its own set of Euler angles (pitch angle $\theta_2$, roll angle $\varphi_2$, yaw angle $\psi_2$) along with a quaternion $q_2$ describing the rotation of attachment member 104 relative to the reference frame 101. Additionally, the attitude of blade 106 is characterized by its set of Euler angles (pitch angle $\theta_3$, roll angle $\varphi_3$, yaw angle $\psi_3$) along with a quaternion $q_3$ describing the rotation of blade 106 relative to the reference frame 101. As previously noted, the attitudes of each component can be determined by one or more sensors coupled to that particular component, for example, via processing logic 400.

Each of these Euler angles and quaternions are determined specific to the reference frame of the component (body 102, attachment member 104, blade 106). The attitude measurements in one frame of reference can be converted into another frame based on the quaternion of the motion between two components. For example, the attitude measurements of body 102 can be converted into the frame of attachment member 104 (and vise-versa) by the quaternion of the lift movement $q_{lift}$ that defines the lifting motion of attachment member 104. When attachment member 104 finishes the lift movement, blade 106 is configured to undergo swinging motion relative to the z3 axis. In doing so, an intermediate frame of reference can be defined in which blade 106 completes the swing motion but has not undergone any tilt motion relative to the x3 axis. This intermediate blade frame is defined by its own Euler angles (pitch angle $\theta_4$, roll angle $\varphi_4$, yaw angle $\psi_4$) and quaternion $q_4$, which can be converted to and from the reference frame of attachment member 104 by the quaternion of the swing motion $q_{swing}$. Blade 106 is then free to undergo tilt motion, which characterizes the orientation of blade 106 by the Euler angles $\psi_3$, $\theta_3$, and $\varphi_3$, with quaternion $q_3$. The attitude of blade 106 in the intermediate blade frame can be converted to the attitude of the blade 106 in its own frame by the quaternion of the tilt motion quilt. Based on the quaternions characterizing the rotation of body 102, attachment member 104, and blade 106, the attitude of one component (e.g., blade 106) can be determined relative to the frame of another component (e.g., attachment member 104 or body 102).

FIG. 7 depicts a table 700 of attitude measurements used to determine the swing angle of a blade. Referring to table 700, column 702 lists the variables used in determining the swing angle, column 704 lists a description of each variable, and column 706 lists the source that determines each variable. In one embodiment, to calculate the swing angle of the blade 106, the blade attitude measurements $\theta_3$, and attachment member measurement $\varphi_2$, $\psi_2$ are used. For example, the intermediate variable T is given by (Equation 1):

$$T = \frac{\sin(\theta_3)}{\left(\cos(\phi_2)^2 * \sin(\phi_2)^2 + \sin(\theta_2)^2\right)^{1/2}}$$

The intermediate variable phi is given by the equation (Equation 2):

$$\text{phi} = a\tan2(-\cos(\theta_2) * \sin(\phi_2), \sin(\theta_2))$$

The swing angle of blade 106 then follows from the equation (Equation 3):

$$\text{swing} = \text{rad2}deg(\text{phi} \pm a\cos(T))$$

where the convention $\pm$ is denoted either + or − depending on the values of $\theta_2$, $\varphi_2$, $\theta_3$. The swing angle can be determined in other ways. Additionally, while the swing angle can be calculated from a two-sensor configuration as described, more sensors can be implemented as well.

In addition to the swing angle, another parameter difficult to reliably determine is the relative heading of blade 106; that is, the heading difference between blade 106 and body 102 of vehicle 100. Conventional solutions attempt to estimate the blade heading by using blade measurements to generate a change in heading between two different time intervals, typically generated from gyroscopes. However, this solution is not accurate and may not be suitable for high precision applications. Additionally, the change in heading determined by gyroscope sensors is prone to drift over time, resulting in a poor estimation of the blade heading during continued operation. While utilizing GNSS technology is available by installing two antennas on each side of blade 106 to estimate the blade heading, utilizing GNSS antennas on the blade risks damage to the antennas, interference with operation of vehicle 102, and is cost-prohibitive. For example, installing GNSS antennas on vehicle 102 is typically complicated and their position on the vehicle 102 may block the field of view of the operator during operation.

A three-sensor configuration can be used to provide a more accurate heading parameter of blade 106. Such a configuration also provides a drift-free and less intrusive means to determine the relative heading of blade 106 that is suitable for even high-precision applications (e.g., for automated driving assistance of vehicle 100). Exemplary embodiments of determining a relative heading of the blade 106 are generally described with reference to FIGS. 2-7.

In some embodiments, the true heading $\psi_1$ of vehicle body 102 can be determined. For example, optional GNSS receiver 214 can be mounted on vehicle body 102 and used to acquire the true heading $\psi_1$. Additionally, or alternatively, other navigation sensors such as magnetometers can be used to obtain the true heading of vehicle body 102. However, determining the true heading $\psi_1$ of vehicle body 102 is optional. In some embodiments, the true heading $\psi_1$ is assumed to be equal to the heading of the level frame upon which vehicle 100 rests, i.e., the relative heading between body 102 and the surface. For a flat surface parallel to vehicle 100, the true heading can therefore be approximated as $\psi_1=0$.

Whether the true heading is determined or approximated, the quaternion of vehicle body 102 can be computed from the pitch $\theta_1$, roll $\varphi_1$, and yaw $\psi_1$ in the reference frame of body 102 by the relationship (Equation 4):

$$q_1 = euler2quat(\psi_1, \theta_1, \phi_1)$$

The lift angle can then be determined from the equations (Equations 5a, 5b):

$$\text{phi} = a\tan2(\cos(\theta_1) * \cos(\phi_1), \sin(\theta_1))$$

$$\text{lift} = \text{rad2}deg(\text{phi} - a\cos(\sin(\theta_2)))$$

The quaternion $q_2$ of the attachment member 104 in the reference frame of attachment member 104 can be determined in a similar manner. However, due to the unique movement of attachment member 104 relative to vehicle body 102, the quaternion can also be determined by considering the restricted movement of attachment member 104. Specifically, since attachment member 104 is configured only for lift movement, the quaternion in the reference frame of attachment member 104 is calculated based on the lift angle by the relationship (Equation 6):

$$q_{lift} = euler2quat(0, \text{lift}, 0)$$

where movement is only confined to the z axis since attachment member 104 does not move in the x or y axes. Consequently, the quaternion $q_2$ of attachment member 104 with respect to the frame of vehicle body 102 then follows from the relationship (Equation 7):

$$q_2 = q_1 * q_{lift}$$

As for blade 106, the swing angle can be determined as previously described with respect to Equations 1-3. In the processing described herein, the order of rotation is assumed, for pedagogical explanation of the blade 106 kinematics, to be the lift rotation, followed by the angle/swing rotation, and ending with the tilt rotation. In some embodiments, an intermediate frame of reference is defined for blade 106 in which the blade has completed the swing rotation about the z3 axis but has not yet initiated a tilt rotation about the x3 axis. This intermediate frame is defined by its own rotation angles $\varphi_4$, $\theta_4$, $\psi_4$. However, in this frame, the pitch $\theta_4$ is equal to $\theta_2$ (since the blade 106 undergoes no additional lift movement) and the yaw $\psi_4$ is also equal to $\psi_3$ (since the blade 106 only undergoes tilt movement). Accordingly, the quaternion of the swing movement in the intermediate frame of the blade 106 is characterized by (Equation 8):

$$q_{swing} = euler2quat(\text{swing}, 0, 0)$$

while the quaternion characterizing the entire motion of blade 106 with respect to the frame of attachment member 104 is (Equation 9):

$$q_4 = q_2 * q_{swing}$$

Since the quaternion $q_4$ represents the entire motion of blade 106 (absent a subsequent tilt movement), the yaw $\psi_4$ of blade 106 can be determined from this quaternion. According to the standard rotation sequence of Euler angles (defined in the order of yaw-pitch-roll), the roll angle is the third rotation along the positive x axis. In the frame of blade 106, rotation along the positive x axis corresponds to the tilt movement of the blade. Since the tilt movement is performed entirely along the positive x axis, the tilt movement does not change the yaw of blade 106. Therefore, the yaw of blade 106 can be determined as equivalent to the yaw of blade 106 in the intermediate frame of motion; that is, $$\psi_3=\psi_4$$

The difference in heading between the heading of blade 106 and the heading of vehicle body 102 in the reference frame of vehicle body 102, i.e., the relative heading, is then determined by the equation (Equation 10):

$$\Delta\psi = \psi_3 - \psi_1$$

Because the swing angle and relative heading are derived from motion of the relative components of the vehicle in their own respective frames, the swing angle and relative heading determined as described is more resistant to measurement drift over time. Accordingly, the swing angle of blade 106 and the relative heading of blade 106 with respect to vehicle body 102 can be determined with greater accuracy, precision, and tolerance over existing techniques.

FIG. 8 depicts a table 800 of the data used to determine the relative heading of the blade 106. Column 802 lists the variables, column 804 lists a brief description of each variable, and column 806 lists the source that determines each variable. The pitch $\theta_1$ and roll $\phi_1$ of body 102 are determined by the body sensor(s) 208. The yaw $\psi_1$ of body 102 (i.e. the true heading) can be optionally determined by the body sensor(s) 208, but can also be inferred without direct measurement of the true heading. The pitch $\theta_2$ and roll $\phi_2$ of attachment member 104 are determined by lift arm sensor(s) 206, optionally along with the yaw $\psi_2$ of attachment member 104.

The pitch $\theta_3$ and roll $\phi_3$ of blade 106 are determined by the blade sensor(s) 204. Rather than utilize the yaw $\psi_3$ of blade 106 directly from blade sensor 204, the yaw $\psi_3$ is derived in the frame of body 102 from the quaternions $q_1$, $q_2$, and $q_4$ of body 102, attachment member 104, and the intermediate frame of blade 106. The quaternion $q_1$ represents the rotation from reference frame 101 (e.g., the frame defined parallel to a surface) to the frame of body 102, is determined based on the attitude measurements of body sensor 208. The quaternion $q_2$ represents the rotation from reference frame 101 to the frame of attachment member 104, and is determined based on the lift movement of attachment member 104 and the attitude measurements of body 102. The quaternion $q_4$ represents the rotation from the reference frame 101 to the intermediate frame of blade 106 between when the blade completes the swing movement (as represented by the swing angle) and before the blade undergoes tilt movement. The quaternion $q_4$ is derived from the swing movement of the blade 106 and the quaternion of the attachment member 104. The Euler angles of rotation in the intermediate frame of blade 106 are then determined from the quaternion $q_4$ and subsequently used to derive the yaw $\psi_3$ of blade 106 in the reference frame of body 102.

Figure 9:
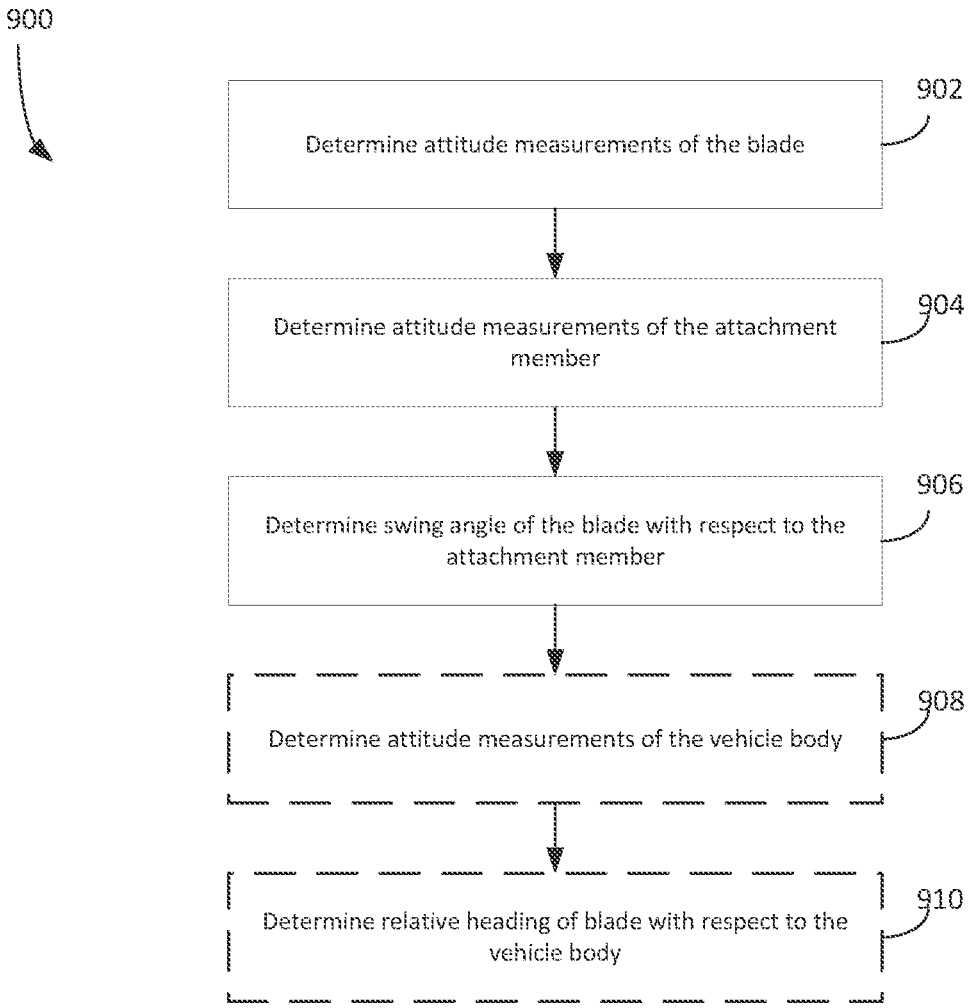
FIG. 9 depicts a flow diagram of a method for determining parameters of a blade, as described in one or more embodiments.

FIG. 9 depicts a flow diagram of a method 900 for determining parameters of a blade. The blade is defined as described in the context of a bulldozer or mechanically similar vehicle. Specifically, the blade is coupled to the vehicle body by way of an attachment member. The vehicle body is configured for lateral movement about a surface, while the attachment member is configured only for lift movement orthogonal to the lateral movement of the vehicle body. The blade is configured for six-way movement, with its lift synchronized with the attachment member and the swing and tilt defined as rotation about the y3 and x3 axes, as shown in FIG. 1.

Method 900 may be implemented via the techniques described with respect to FIGS. 1-8, but may be implemented via other techniques as well. The blocks of the flow diagram have been arranged in a generally sequential manner for case of explanation; however, it is to be understood that this arrangement is merely exemplary, and it should be recognized that the processing associated with the methods described herein (and the blocks shown in the Figures) may occur in a different order (for example, where at least some of the processing associated with the blocks is performed in parallel and/or in an event-driven manner).

Method 900 includes determining attitude measurements of a blade at block 902. For example, attitude measurements, including the pitch angle $\theta_3$ and roll angle $\phi_3$ of blade 106, can be determined by at least one sensor 204 coupled to a portion of blade 106. Proceeding to block 904, method 900 determines attitude measurements of the attachment member. As shown in FIG. 1, at least one sensor 206 is coupled to a portion of attachment member 104 and configured to determine the pitch angle $\theta_2$ and roll angle $\phi_2$. The attitude measurements of the blade determined at block 902 and the attitude measurements of the attachment member determined at block 904 are made with respect to the specific frame of reference. Specifically, the attitude measurements of blade 106 are made in the reference frame of blade 106, while the attitude measurements of attachment member 104 are made in the reference frame of attachment member 104.

Method 900 then determines the swing angle of the blade with respect to the attachment member at block 906. For example, processor 210 receives the attitude measurements of blade 106 and attachment member 104 from sensors 204 and 206, respectively, and determines the swing angle based on Equations 1-3. More generally, method 900 converts the attitude measurements of blade 106 from the reference frame of blade 106 to the reference frame of attachment member 104, and determines the swing angle of blade 106 based on the converted attitude measurements of blade 106 in the reference frame of attachment member 104 and the attitude measurements of attachment member 104.

Optionally, method 900 includes steps for determining other heading parameters of blade 106, such as the relative heading between blade 106 and vehicle body 102. In some embodiments, method 900 then proceeds to block 908 and determines attitude measurements of the vehicle body. For example, at least one sensor 208 can be coupled to a portion of the body 102, such as on chassis 108, and configured to determine the roll angle $\phi_1$, pitch angle $\theta_1$, and yaw angle (heading) $\psi_1$. Then, at block 910, method 900 determines the relative heading of the blade with respect to the vehicle body. For example, processor 210 receives the attitude measurements of body 102, attachment member 104, and blade 106, and determines the relative heading of blade 106 based on Equations 4-10.

Figure 10:
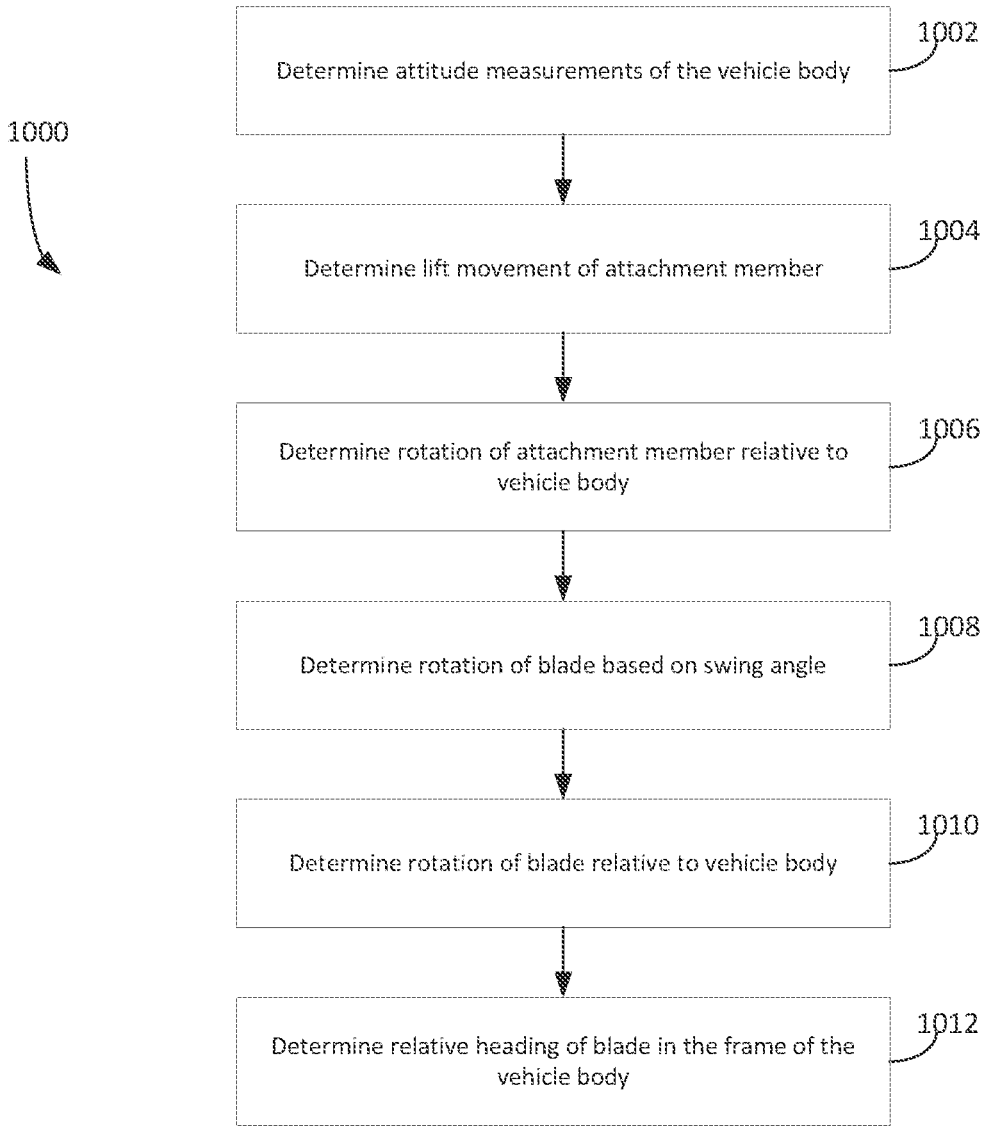
FIG. 10 depicts a flow diagram of a method for determining a relative heading of the blade with respect to the vehicle body, as described in one or more embodiments.

FIG. 10 depicts a flow diagram of a method 1000 for determining a relative heading of the blade with respect to the vehicle body. Method 1000 is an exemplary embodiment for determining the relative heading of blade 106 as would be performed as part of blocks 908-910 of method 900. Method 1000 includes determining attitude measurements of the vehicle body at block 1002. Subsequently, or in parallel, method 1000 determines the lift movement of the attachment member coupled to the vehicle body at block 1004. The lift movement of the attachment member can be determined by determining the quaternion $q_{lift}$ of the lift movement relative to the reference frame 101, based on the attitude measurements of attachment member 104.

Proceeding to block 1006, method 1000 determines the rotation of the attachment member relative to the vehicle body. Referring to Equation 7, in some embodiments method 1000 determines the quaternion $q_2$ based on the quaternion $q_1$ characterizing rotation of the vehicle body 102 relative to the reference frame 101 and the quaternion quint characterizing the lift movement of the attachment member 104. At block 1008, method 1000 determines the rotation of the blade based on the swing angle. The swing angle can be determined as described with respect to block 906 of method 900 and/or as described with respect to Equations 1-3.

Method 1000 then determines, at block 1010, the rotation of the blade relative to the vehicle body. For example, referring to Equation 9, the quaternion $q_4$ characterizing the lift and swing rotation of blade 106 can be computed based on the quaternion $q_2$ of the attachment member 104 and the quaternion $q_{swing}$ of the swing motion. Method 1000 then determines the relative heading of the blade in the frame of the vehicle body at block 1012. For example, once the quaternion $q_4$ is determined, the heading of the blade 106 can be determined based on the relationship between the rotation of the blade 106 in the intermediate blade frame and the rotation of the blade 106 after it completes the tilt movement about the x3 axis. The heading of the blade 106 can then be converted to the frame of the body 102, and the relative heading between the body 102 and the blade 106 can be determined by the difference between the two headings.

The methods and techniques described herein may be implemented in digital electronic circuitry, or with a programmable processor (for example, a special-purpose processor or a general-purpose processor such as a computer) firmware, software, or in various combinations of each. Apparatus embodying these techniques may include appropriate input and output devices, a programmable processor, and a storage medium tangibly embodying program instructions for execution by the programmable processor. A process embodying these techniques may be performed by a programmable processor executing a program of instructions to perform desired functions by operating on input data and generating appropriate output. The techniques may advantageously be implemented in one or more programs that are executable on a programmable system including at least one programmable processor coupled to receive data and instructions from, and to transmit data and instruction to, a data storage system, at least one input device, and at least one output device. Generally, a processor will receive instructions and data from a read-only memory and/or a random-access memory. Storage devices suitable for tangibly embodying computer program instructions and data include all forma of non-volatile memory, including by way of example semiconductor memory devices, such as erasable programmable read-only memory (EPROM), electrically-erasable programmable read-only memory (EEPROM), and flash memory devices; magnetic disks such as internal hard disks and removable disks; magneto-optical disks; and the like. Any of the foregoing may be supplemented by, or incorporated in, specially-designed application specific integrated circuits (ASICs).

Example Embodiments

Example 1 includes a system, comprising: a vehicle comprising a body, a blade, and an attachment member that couples the blade to the body, wherein the attachment member is configured for lift movement, wherein the lift movement is defined as a rotation along a horizontal axis with respect to the body, wherein the blade is configured for swing movement, wherein the swing movement is defined as a rotation along an axis orthogonal to an axis of the lift movement with respect to the attachment member; and a plurality of sensors mounted on the vehicle, wherein at least one first sensor of the plurality of sensors is configured to determine attitude measurements of the blade with respect to an inertial reference frame, wherein at least one second sensor of the plurality of sensors is configured to determine attitude measurements of the attachment member with respect to the inertial reference frame, and at least one processor coupled to or integrated in the at least one first sensor, wherein the at least one processor is configured to determine at least one parameter of the blade based on the attitude measurements of the blade and the attitude measurements of the attachment member, wherein the at least one parameter includes a swing angle of the blade relative to the attachment member.

Example 2 includes the system of Example 1, wherein the plurality of sensors comprises at least one third sensor, wherein the at least one third sensor of the plurality of sensors is configured to determine attitude measurements of the body with respect to the inertial reference frame, wherein the at least one processor is configured to determine the at least one parameter based on the attitude measurements of the body, wherein the at least one parameter comprises a relative heading of the blade with respect to the body.

Example 3 includes the system of any of Examples 1-2, wherein the attitude measurements of the blade comprise a pitch angle of the blade, wherein the attitude measurements of the attachment member comprise a pitch angle of the attachment member and a roll angle of the attachment member.

Example 4 includes the system of any of Examples 1-3, wherein each of the plurality of sensors comprises an inertial measurement unit (IMU), accelerometer, gyroscope, and/or a tilt sensor.

Example 5 includes the system of any of Examples 2-4, wherein the at least one first sensor is physically coupled to a portion of the blade, wherein the at least one second sensor is physically coupled to a portion of the attachment member, wherein the at least one third sensor is physically coupled to a portion of the body.

Example 6 includes the system of any of Examples 1-5, wherein the at least one processor is configured to determine the swing angle of the blade based on the equation:

$$T = \frac{\sin(\theta_3)}{\left(\cos(\phi_2)^2 * \sin(\phi_2)^2 + \sin(\theta_2)^2\right)^{1/2}}$$

wherein $\theta_2$ represents a pitch angle of the attachment member, $\phi_2$ represents a roll angle of the attachment member, and $\theta_3$ represents a pitch angle of the blade.

Example 7 includes the system of any of Examples 2-6, wherein the attitude measurements of the body include a pitch angle, roll angle, and heading of the body with respect to the inertial reference frame.

Example 8 includes the system of Example 7, wherein to determine the relative heading of the blade, the at least one processor is configured to: determine attitude measurements of an intermediate frame of the blade with respect to the inertial reference frame, wherein the intermediate frame corresponds to a frame in which the blade has completed the lift movement and the swing movement without any tilt movement determine a rotation of the intermediate frame with respect to the inertial reference frame; determine the heading of the blade with respect to the inertial reference frame based on the rotation of the intermediate frame and the attitude measurements of the blade; and determine the relative heading of the blade based on a difference between the heading of the body and the heading of the blade.

Example 9 includes a method for determining parameters of a blade attached to a vehicle, wherein the vehicle includes a body and an attachment member that couples the blade to the body, wherein movement of the blade is defined orthogonal to an axis of motion with respect to the attachment member, wherein the attachment member is configured for lift movement, wherein the lift movement is defined as a rotation along a horizontal axis with respect to the body, wherein the blade is configured for swing movement, wherein the swing movement is defined as a rotation along an axis orthogonal to an axis of the lift movement with respect to the attachment member, the method comprising: determining attitude measurements of the blade with respect to an inertial reference frame; determining attitude measurements of the attachment member with respect to the inertial reference frame; and determining a swing angle of the blade with respect to the attachment member based on the attitude measurements of the blade and the attitude measurements of the attachment member.

Example 10 includes the method of Example 9, further comprising: determining attitude measurements of the body with respect to a reference frame of the body, wherein the attitude measurements include a heading of the body; and determining a relative heading of the blade with respect to the body based on the attitude measurements of the body.

Example 11 includes the method of any of Examples 9-10, further comprising: determining attitude measurements of the body with respect to the inertial reference frame, wherein the attitude measurements include a heading of the body; determining the lift movement of the attachment member; determining a rotation of the attachment member relative to the body; determining a rotation of the blade with respect to the attachment member based on the swing angle; determining a rotation of the blade relative to the body from the rotation of the blade with respect to the attachment member and the rotation of the attachment member relative to the body; and determining a relative heading of the blade in the frame of the body based on rotation of the blade relative to the body.

Example 12 includes the method of any of Examples 9-11, wherein the attitude measurements of the blade comprise a pitch angle of the blade, wherein the attitude measurements of the attachment member comprise a pitch angle of the attachment member and a roll angle of the attachment member.

Example 13 includes the method of any of Examples 11-12, wherein determining rotation of the attachment member relative to the body comprises: determining a first quaternion of rotation corresponding to the lift movement of the attachment member; determining a second quaternion of rotation corresponding to movement of the body with respect to a reference frame local to the vehicle; and determining a third quaternion of rotation of the attachment member from the first quaternion of rotation and the second quaternion of rotation.

Example 14 includes the method of Example 13, wherein determining the rotation of the blade relative to the body comprises: determining a fourth quaternion of rotation based on the swing angle of the blade; and determining a fifth quaternion of rotation of the blade from the third quaternion of rotation and the fourth quaternion of rotation.

Example 15 includes the method of Example 14, wherein determining the relative heading of the blade comprises: determining a heading of the blade from the fifth quaternion of rotation of the blade; determining a heading of the body; and determining the relative heading of the blade based on a difference between the heading of the blade and the heading of the body.

Example 16 includes a sensor system configured to be coupled to a vehicle, the vehicle comprising a body, a blade, and an attachment member that couples the blade to the body, the sensor system comprising: at least one first sensor, wherein the at least one first sensor is configured to determine first attitude measurements of the blade, wherein the first attitude measurements are determined with respect to an inertial reference frame, wherein the first attitude measurements include an attitude of the blade corresponding to horizontal rotation of the blade defined orthogonal to an axis of the attachment member, at least one second sensor, wherein the at least one second sensor is configured to determine second attitude measurements of the attachment member, wherein the second attitude measurements are determined with respect to the inertial reference frame, wherein the second attitude measurements include an attitude of the attachment member corresponding to vertical rotation of the attachment member defined orthogonal to an axis of the body, at least one processor coupled to, or integrated in, the at least one first sensor and the at least one second sensor, wherein the at least one processor is configured to determine a swing angle of the blade relative to the attachment member based on the first attitude measurements and the second attitude measurements.

Example 17 includes the sensor system of Example 16, comprising at least one third sensor coupled to the at least one processor, wherein the at least one third sensor is configured to determine third attitude measurements of the body with respect to the inertial reference frame, wherein the at least one processor is configured to determine a relative heading of the blade relative to the body based on the first attitude measurements of the blade, the second attitude measurements of the attachment member, and the third attitude measurements of the body.

Example 18 includes the sensor system of Example 17, wherein the at least one first sensor is disposed on a portion of the blade, wherein the at least one second sensor is disposed on a portion of the attachment member, wherein the at least one third sensor is disposed on a portion of the body.

Example 19 includes the sensor system of any of Examples 16-18, wherein the first attitude measurements of the blade comprise a pitch angle of the blade and a roll angle of the blade, wherein the second attitude measurements of the attachment member comprise a pitch angle of the attachment member and a roll angle of the attachment member.

Example 20 includes the sensor system of any of Examples 17-19, wherein each of the at least one first sensor, the at least one second sensor, and the at least one third sensor comprises an inertial measurement unit (IMU), accelerometer, gyroscope, and/or a tilt sensor.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A system, comprising:

a vehicle comprising a body, a blade, and an attachment member that couples the blade to the body, wherein the attachment member is configured for lift movement, wherein the lift movement is defined as a rotation along a horizontal axis with respect to the body, wherein the blade is configured for swing movement, wherein the swing movement is defined as a rotation along an axis orthogonal to an axis of the lift movement with respect to the attachment member; and a plurality of sensors mounted on the vehicle, wherein at least one first sensor of the plurality of sensors is configured to determine attitude measurements of the blade with respect to an inertial reference frame, wherein at least one second sensor of the plurality of sensors is configured to determine attitude measurements of the attachment member with respect to the inertial reference frame, and at least one processor coupled to or integrated in the at least one first sensor, wherein the at least one processor is configured to determine at least one parameter of the blade based on the attitude measurements of the blade and the attitude measurements of the attachment member, wherein the at least one parameter includes a swing angle of the blade relative to the attachment member;

wherein the at least one processor is configured to determine the swing angle of the blade based on the equation:

$$T = \sin(\theta_3)/\left(\cos(\Phi_2)^2 * \sin(\Phi_2)^2 + \sin(\theta_2)^2\right)^{1/2}$$

where $\theta_2$ represents a pitch angle of the attachment member, $\Phi_2$ represents a roll angle of the attachment member, and $\theta_3$ represents a pitch angle of the blade, and wherein the blade is configured to be moved based on the determined swing angle of the blade.

2. The system of claim 1, wherein the plurality of sensors comprises at least one third sensor, wherein the at least one third sensor of the plurality of sensors is configured to determine attitude measurements of the body with respect to the inertial reference frame, wherein the at least one processor is configured to determine the at least one parameter based on the attitude measurements of the body, wherein the at least one parameter comprises a relative heading of the blade with respect to the body.

3. The system of claim 1, wherein the attitude measurements of the blade comprise a pitch angle of the blade, wherein the attitude measurements of the attachment member comprise a pitch angle of the attachment member and a roll angle of the attachment member.

4. The system of claim 1, wherein each of the plurality of sensors comprises an inertial measurement unit (IMU), accelerometer, gyroscope, and/or a tilt sensor.

5. The system of claim 2, wherein the at least one first sensor is physically coupled to a portion of the blade, wherein the at least one second sensor is physically coupled to a portion of the attachment member, wherein the at least one third sensor is physically coupled to a portion of the body.

6. The system of claim 2, wherein the attitude measurements of the body include a pitch angle, roll angle, and heading of the body with respect to the inertial reference frame.

7. The system of claim 6, wherein to determine the relative heading of the blade, the at least one processor is configured to:

determine attitude measurements of an intermediate frame of the blade with respect to the inertial reference frame, wherein the intermediate frame corresponds to a frame in which the blade has completed the lift movement and the swing movement without any tilt movement;

determine a rotation of the intermediate frame with respect to the inertial reference frame;

determine the heading of the blade with respect to the inertial reference frame based on the rotation of the intermediate frame and the attitude measurements of the blade; and determine the relative heading of the blade based on a difference between the heading of the body and the heading of the blade.

8. A method for determining parameters of a blade attached to a vehicle, wherein the vehicle includes a body and an attachment member that couples the blade to the body, wherein movement of the blade is defined orthogonal to an axis of motion with respect to the attachment member, wherein the attachment member is configured for lift movement, wherein the lift movement is defined as a rotation along a horizontal axis with respect to the body, wherein the blade is configured for swing movement, wherein the swing movement is defined as a rotation along an axis orthogonal to an axis of the lift movement with respect to the attachment member, the method comprising:

determining attitude measurements of the blade with respect to an inertial reference frame;

determining attitude measurements of the attachment member with respect to the inertial reference frame; and determining a swing angle of the blade with respect to the attachment member based on the attitude measurements of the blade and the attitude measurements of the attachment member;

wherein the swing angle of the blade is determined based on the equation:

$$T = \frac{\sin(\theta_3)}{\left(\cos(\phi_2)^2 * \sin(\phi_2)^2 + \sin(\theta_2)^2\right)^{1/2}}$$

where $\theta_2$ represents a pitch angle of the attachment member, $\Phi_2$ represents a roll angle of the attachment member, and $\theta_3$ represents a pitch angle of the blade, and wherein the blade is configured to be moved based on the determined swing angle of the blade.

9. The method of claim 8, further comprising:

determining attitude measurements of the body with respect to a reference frame of the body, wherein the attitude measurements include a heading of the body; and determining a relative heading of the blade with respect to the body based on the attitude measurements of the body.

10. The method of claim 8, further comprising:

determining attitude measurements of the body with respect to the inertial reference frame, wherein the attitude measurements include a heading of the body;

determining the lift movement of the attachment member;

determining a rotation of the attachment member relative to the body;

determining a rotation of the blade with respect to the attachment member based on the swing angle;

determining a rotation of the blade relative to the body from the rotation of the blade with respect to the attachment member and the rotation of the attachment member relative to the body; and determining a relative heading of the blade in the frame of the body based on rotation of the blade relative to the body.

11. The method of claim 8, wherein the attitude measurements of the blade comprise a pitch angle of the blade, wherein the attitude measurements of the attachment member comprise a pitch angle of the attachment member and a roll angle of the attachment member.

12. The method of claim 10, wherein determining rotation of the attachment member relative to the body comprises:

determining a first quaternion of rotation corresponding to the lift movement of the attachment member;

determining a second quaternion of rotation corresponding to movement of the body with respect to a reference frame local to the vehicle; and determining a third quaternion of rotation of the attachment member from the first quaternion of rotation and the second quaternion of rotation.

13. The method of claim 12, wherein determining the rotation of the blade relative to the body comprises:

determining a fourth quaternion of rotation based on the swing angle of the blade; and determining a fifth quaternion of rotation of the blade from the third quaternion of rotation and the fourth quaternion of rotation.

14. The method of claim 13, wherein determining the relative heading of the blade comprises:

determining a heading of the blade from the fifth quaternion of rotation of the blade;

determining a heading of the body; and determining the relative heading of the blade based on a difference between the heading of the blade and the heading of the body.

15. A sensor system configured to be coupled to a vehicle, the vehicle comprising a body, a blade, and an attachment member that couples the blade to the body, the sensor system comprising:

at least one first sensor, wherein the at least one first sensor is configured to determine first attitude measurements of the blade, wherein the first attitude measurements are determined with respect to an inertial reference frame, wherein the first attitude measurements include an attitude of the blade corresponding to horizontal rotation of the blade defined orthogonal to an axis of the attachment member, at least one second sensor, wherein the at least one second sensor is configured to determine second attitude measurements of the attachment member, wherein the second attitude measurements are determined with respect to the inertial reference frame, wherein the second attitude measurements include an attitude of the attachment member corresponding to vertical rotation of the attachment member defined orthogonal to an axis of the body, at least one processor coupled to, or integrated in, the at least one first sensor and the at least one second sensor, wherein the at least one processor is configured to determine a swing angle of the blade relative to the attachment member based on the first attitude measurements and the second attitude measurements;

wherein the at least one processor is configured to determine the swing angle of the blade based on the equation:

$$T = \sin(\theta_3)/\left(\cos(\Phi_2)^2 * \sin(\Phi_2)^2 + \sin(\theta_2)^2\right)^{1/2}$$

where $\theta_2$ represents a pitch angle of the attachment member, $\Phi_2$ represents a roll angle of the attachment member, and $\theta_3$ represents a pitch angle of the blade, and wherein the blade is configured to be moved based on the determined swing angle of the blade.

16. The sensor system of claim 15, comprising at least one third sensor coupled to the at least one processor, wherein the at least one third sensor is configured to determine third attitude measurements of the body with respect to the inertial reference frame, wherein the at least one processor is configured to determine a relative heading of the blade relative to the body based on the first attitude measurements of the blade, the second attitude measurements of the attachment member, and the third attitude measurements of the body.

17. The sensor system of claim 16, wherein the at least one first sensor is disposed on a portion of the blade, wherein the at least one second sensor is disposed on a portion of the attachment member, wherein the at least one third sensor is disposed on a portion of the body.

18. The sensor system of claim 15, wherein the first attitude measurements of the blade comprise a pitch angle of the blade and a roll angle of the blade, wherein the second attitude measurements of the attachment member comprise a pitch angle of the attachment member and a roll angle of the attachment member.

19. The sensor system of claim 16, wherein each of the at least one first sensor, the at least one second sensor, and the at least one third sensor comprises an inertial measurement unit (IMU), accelerometer, gyroscope, and/or a tilt sensor.

* * * * *